US005647513A

United States Patent [19]

Favre

[11] Patent Number: 5,647,513

[45] Date of Patent: Jul. 15, 1997

[54] PROPORTIONING DEVICE FOR DOUBLE DISPENSER

[75] Inventor: Bernard Favre, Chevilly-Larue, France

[73] Assignee: LIR France, Chevilly-Larue, France

[21] Appl. No.: 528,984

[22] Filed: Sep. 15, 1995

[30] Foreign Application Priority Data

Sep. 15, 1994 [FR] France ..... 94 11023

[51] Int. Cl.[6] ..... B67D 5/60

[52] U.S. Cl. ..... 222/134

[58] Field of Search ..... 222/144.5, 134, 222/145.7, 145.8, 330, 321.7, 321.9, 478

[56] References Cited

U.S. PATENT DOCUMENTS

| | | | |
|---|---|---|---|
| 3,439,841 | 4/1969 | Rhodes | 222/142.5 |
| 4,838,457 | 6/1989 | Swahl et al. | 222/144.5 |
| 4,893,729 | 1/1990 | Iggulden et al. | 222/134 |
| 5,152,431 | 10/1992 | Gardner et al. | 222/144.5 |
| 5,152,432 | 10/1992 | De Laforcade | 222/145.7 |

FOREIGN PATENT DOCUMENTS 24 44 227 3/1976 Germany .

*Primary Examiner*—Philippe Derakshani
*Attorney, Agent, or Firm*—Young & Thompson

[57] ABSTRACT

A proportioning device for a double dispenser has a double receptacle and a dispensing head (1), the device having, facing outlet openings (6) for the products, openings (5) of different or equal diameters. The proportioning device has a capsule (2) screwed on the dispensing head (1), having a constriction (3) holding a disk (4) having at least one pair of openings (5) of different or equal diameters which are diametrically opposed. The capsule (2) and disk (4) are covered by a ring (8) driving the disk (4) in rotation the disk (4) by teeth on the external periphery of the disk meshing with teeth on the internal surface of the ring. Use for the distribution of liquid or pasty cosmetic products.

1 Claim, 3 Drawing Sheets

PROPORTIONING DEVICE FOR DOUBLE DISPENSER

BACKGROUND OF THE INVENTION

1. Field of the Invention

The present invention relates to a proportioning device for a double dispenser, in particular for the dispensing of cosmetic products.

2. Description of the Related Art

In the field of cosmetics in particular, there is an increasingly frequent use of receptacles enclosing two active principal ingredients. Most of the time, when these products cannot be stored in the form of a mixture, double dispensers have been separately provided to enclose the two products. Their contact and/or mixture takes place, in this case, only at the time of simultaneous distribution of the two products.

This double dispensing of liquid or pasty products can be carried out in various ways. Thus, it can be considered that the two products can be distributed in parallel streams when it is not sought to mix them together, or on the contrary in mixed streams or again the two products can be dispensed in two different proportions, which is to say with different flow rates.

In this case, it is therefore necessary to be able to vary the flow rate of one of the products relative to the other.

DE-A-2.444.227 discloses a double dispenser with concentric compartments, provided with a distributor cap beneath which are disposed a first cover provided with a series of openings of different diameters for the first compartment and a second cover provided with openings of different diameters for the second compartment. The positioning of the open openings of the compartments takes place by rotation of the covers connected to each other. However, this type of dispenser is not satisfactory because it relies on a construction comprising concentric compartments and two covers, which implies a complicated and costly production.

It is accordingly desirable to provide a dispensing device permitting varying the distribution flow rates of the products enclosed in a double dispenser with adjacent compartments.

For this purpose, the invention equips a dispensing head of a double dispenser with a proportioning device comprising, facing outlet openings of the two products, openings of different or equal diameters, characterized in that said device comprises a capsule fixed, for example by screwing, on the dispensing head, this capsule having a constriction adapted to receive an open disk comprising at least one pair of said diametrically opposed openings of different or the same diameters, said capsule and said disk being covered by a ring turning about the capsule which drives the disk in rotation.

Preferably, the disk is open, which facilitates its molding and its assembly.

The disk preferably comprises at least one pair of openings on the surface of the disk and of different diameters, the disk being then positioned such that one of the openings will face the outlet opening of the second product, thereby adjusting the flow rate of the two products in a differentiated manner.

Preferably, the ring drives the disk in rotation by means of teeth on its outer periphery, which teeth match the teeth on the ring.

The ring preferably has in its lower portion an indexing system to allow the adjustment, by simple rotation of the ring, of the caliber of the outlet openings of the two products enclosed in the double dispenser. During emplacement of the different elements, the ring is carefully positioned on the capsule and the disk as a function of the type of indexing selected.

There is thus obtained a double dispenser in which the outlet flow rates of the two products can preferably be selected to be different from each other according to their proportion and according to the intended use.

The device of the invention is simple and easy to produce and moreover permits, by the presence of several pairs of openings on the disk, several choices as to flow rates to be used.

BRIEF DESCRIPTION OF THE DRAWINGS

There will now be described more in detail an example of embodiment of the invention with reference to the accompanying drawing, in which.

DESCRIPTION OF THE PREFERRED EMBODIMENT

Figure 1:
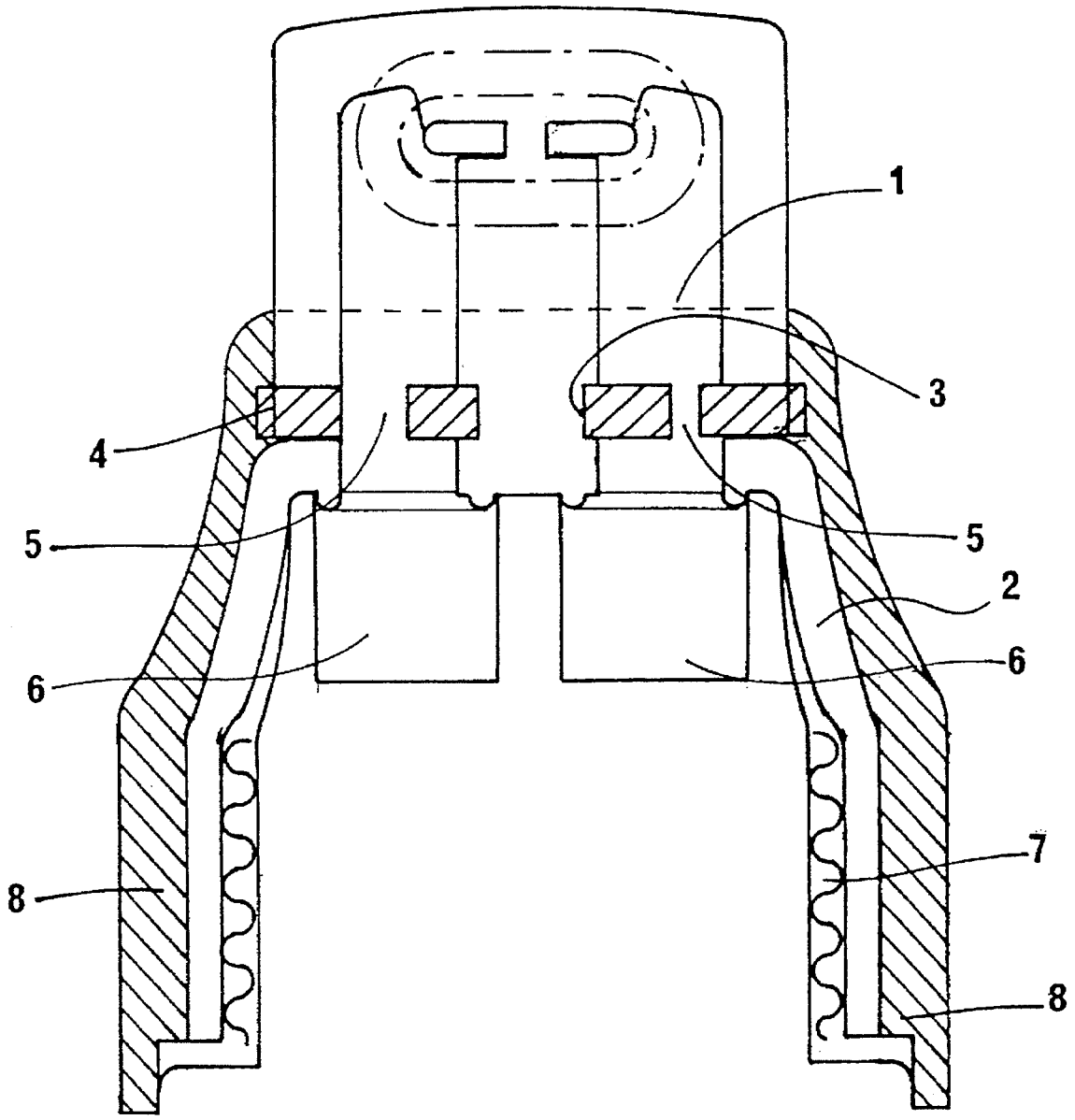
FIG. 1 shows a cross-sectional side view of a double dispensing head provided with a proportioning device according to the invention.
Figure 2:
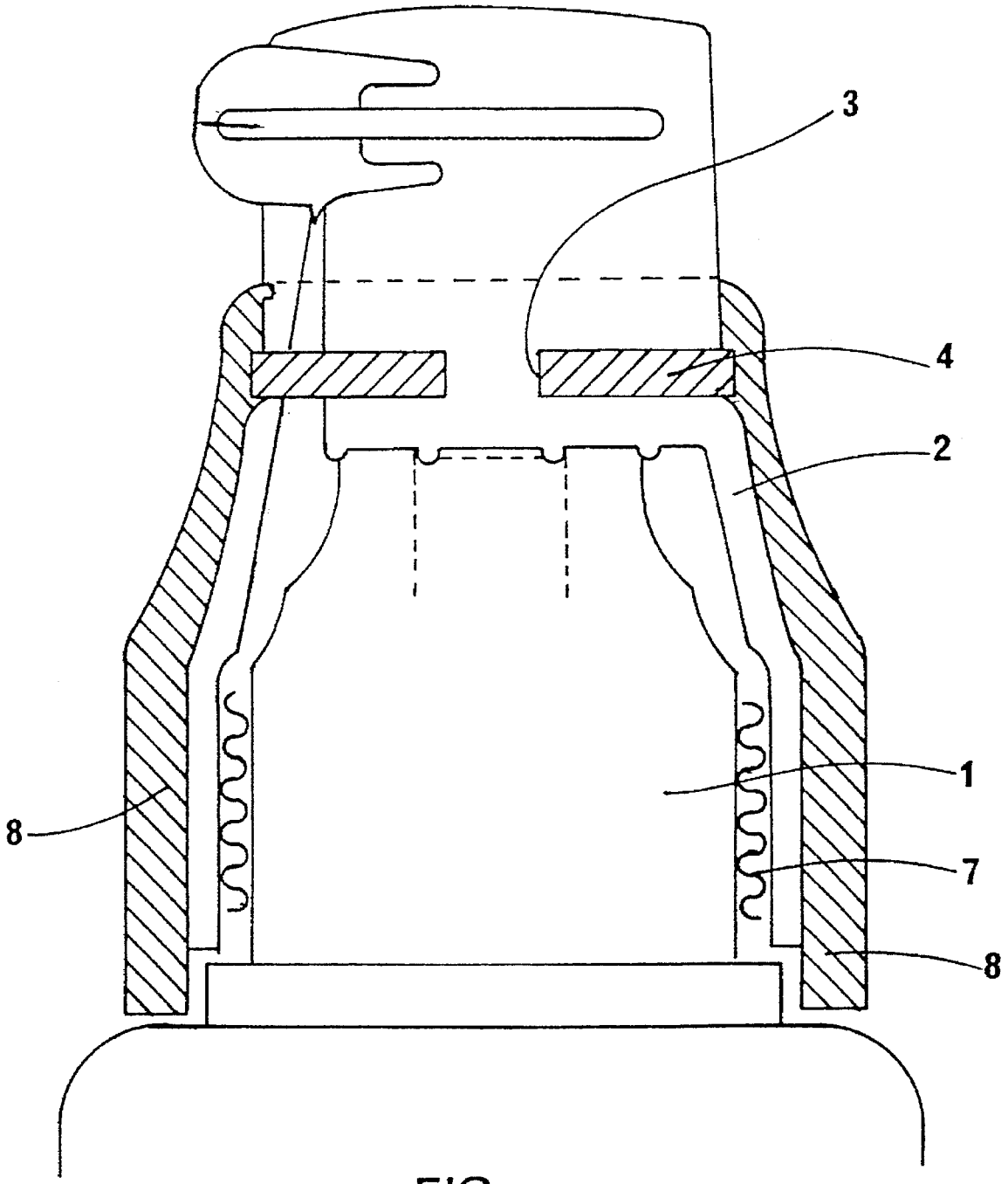
FIG. 2 is a cross-sectional view taken 90° from the preceding, of a double dispensing head of FIG. 1.
Figure 3:
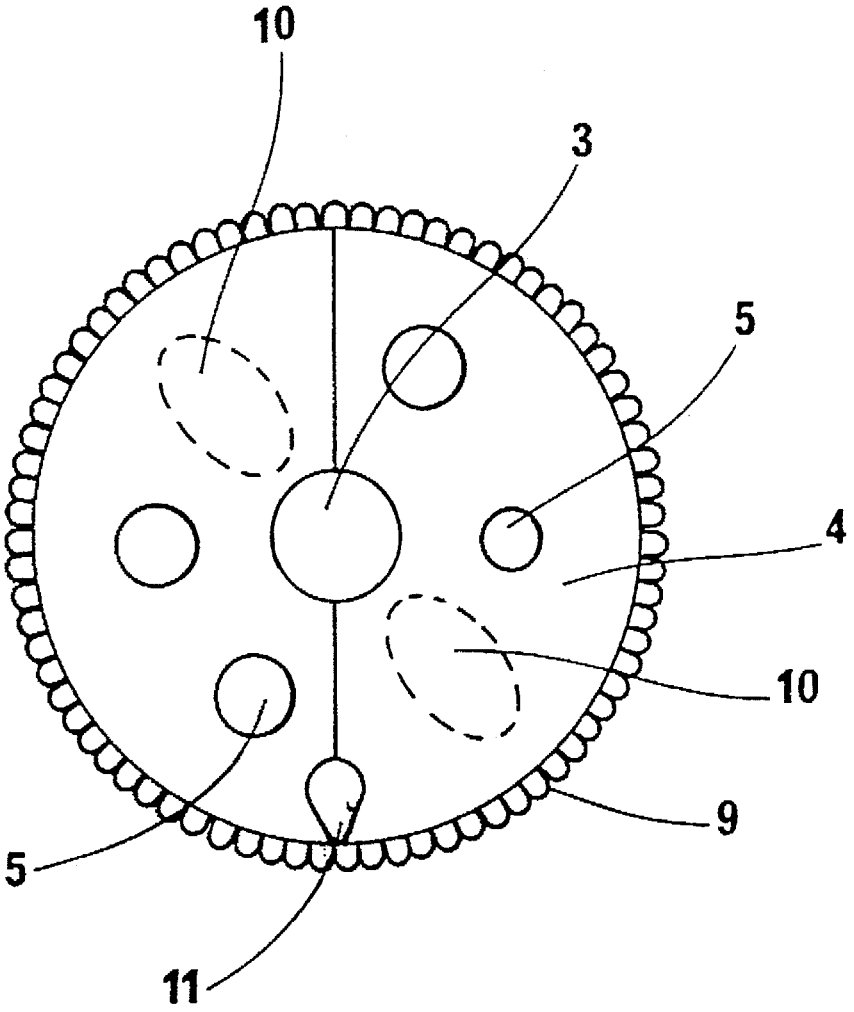
FIG. 3 is a top plan view of a disk of the device according to the device of the invention.

A capsule 2 is fixed on a double dispensing head 1 of a receptacle (not shown) by screwing. The capsule 2 is made such that its securement on the dispensing head 1 will be sealed. Any other suitable securement mode could be used. Said capsule 2 also has a constriction 3 which receives a disk 4. Said disk 4 has, on its surface, diametrically opposed pairs of openings 5 of different diameters which, during emplacement of the disk 4, come to face the outlet openings 6 in the dispensing head 1 for the products contained in the receptacle.

In the example described, the dispensing head 1 has a screw-threading 7 on which can be screwed the capsule 2 which has a corresponding tapping.

Then, on the two members, meaning the dispensing head 1 and the capsule 2, there is fitted a locking ring 8 which has teeth on its internal surface which correspond to the teeth 9 of the disk 4, so as to form an indexing system.

The disk 4 has several pairs of diametrically opposed through openings 5 of different diameters. Each pair of openings 5 allows the production of different flow rates between the two products contained in the receptacle, or allows equal flow rates, if the openings 5 have the same diameter.

A simple rotation of the ring 8 allows a modification of the flow rate of the products, the ring 8 driving the rotation of the disk 4. As a result, the rotation of the ring 8 permits changing of the openings 5 of the disk 4 facing the outlet openings for the products.

Preferably, the disk is made open, which is to say it opens in two parts about a bend line 11 so as to be adapted for the constriction 3 of the capsule 2. The ultimate emplacement of the gripping and locking ring 8 maintains it closed. The disk 4 also comprises a flat surface 10 (shown in phantom line) corresponding to a closed position of the dispensing head.

The proportioning device according to the invention is preferably adapted for double dispensing heads of receptacles for cosmetic products but can be also used in all fields which use the double dispensing of liquid or pasty products as for example the field of glues.

I claim:

1. Proportioning device for a double dispenser for dispensing two products comprising a double receptacle and a dispensing head (1), said device comprising an outlet opening (6) for each product, and through openings (5) of different or equal diameters, facing said outlet openings, a capsule (2) fixed on the dispensing head (1), said capsule (2) having a constriction (3) that holds a disk (4) comprising at least one pair of said through openings (5), said at least one pair of through openings being diametrically opposed, said capsule (2) and said disk (4) being covered by a ring (8) turning about the capsule (2) which drives the disk (4) in rotation via teeth (9) on an external periphery of the disk (4) meshing with teeth on an internal surface of the ring (8).

* * * * *